US011549286B1

(12) United States Patent
Chen

(10) Patent No.: US 11,549,286 B1
(45) Date of Patent: Jan. 10, 2023

(54) LOCK BAR-ON-SLIDE RAIL STYLE DRAWER ANTITIPPING SAFETY DEVICE

(71) Applicant: Yi-Chun Chen, Taipei (TW)

(72) Inventor: Yi-Chun Chen, Taipei (TW)

( * ) Notice: Subject to any disclaimer, the term of this patent is extended or adjusted under 35 U.S.C. 154(b) by 0 days.

(21) Appl. No.: 17/543,743

(22) Filed: Dec. 7, 2021

(51) Int. Cl.

| | |
|---|---|
| ***E05B 65/463*** | (2017.01) |
| ***A47B 88/40*** | (2017.01) |
| ***A47B 88/57*** | (2017.01) |
| ***A47B 88/50*** | (2017.01) |
| ***A47B 97/00*** | (2006.01) |

(52) U.S. Cl.
CPC ..... *E05B 65/463* (2013.01); *A47B 88/40* (2017.01); *A47B 88/50* (2017.01); *A47B 88/57* (2017.01); *A47B 2097/008* (2013.01); *A47B 2210/0024* (2013.01)

(58) Field of Classification Search
CPC .... E05B 65/462; E05B 65/463; E05B 65/464; A47B 2097/008; A47B 88/50; A47B 2210/0086
See application file for complete search history.

(56) References Cited

U.S. PATENT DOCUMENTS 3,888,558 A * 6/1975 Himsl ..... E05B 65/463 312/216
3,969,008 A * 7/1976 Pergler ..... E05B 65/464 312/221
5,184,887 A * 2/1993 O'Keefe ..... E05B 65/464 70/81
5,829,859 A * 11/1998 Cram ..... E05B 65/464 312/283
6,186,606 B1 * 2/2001 Krei ..... E05B 65/46 312/221
6,296,332 B1 * 10/2001 Lammens ..... E05B 65/464 312/217
8,201,899 B2 * 6/2012 Arriola Arrizabalaga ..... E05B 65/463 312/221
8,696,074 B2 * 4/2014 Romaen ..... E05B 65/464 312/215

FOREIGN PATENT DOCUMENTS

DE 10124684 C1 * 3/2003 ..... E05B 65/463
KR 101823370 B1 * 1/2018 ..... E05B 65/463

* cited by examiner

*Primary Examiner* — Andrew M Roersma
(74) *Attorney, Agent, or Firm* — Leong C. Lei

(57) ABSTRACT

A lock bar-on-slide rail style drawer antitipping safety device includes a cabinet body, a top drawer, at least one middle drawer, and at least one bottom drawer. The drawers are each provided with a sliding portion projecting from one side thereof. The cabinet body includes a vertical slide rail slidably mounted at one side that corresponds to the sliding portions. The vertical slide rail includes, in sequence from top to bottom, a first lock bar, a second lock bar, and a third lock bar slidably mounted thereto. Each of the first lock bar and the second lock bar is provided with a stop portion projecting from each of a top end and a bottom end thereof toward the corresponding sliding portion. The stop portions are provided to selectively block the sliding portions so as to prevent the drawers from accidentally sliding out or being opened simultaneously.

4 Claims, 9 Drawing Sheets

LOCK BAR-ON-SLIDE RAIL STYLE DRAWER ANTITIPPING SAFETY DEVICE

TECHNICAL FIELD OF THE INVENTION

The present invention relates to a drawer locking device, and more particularly to a lock bar-on-slide rail style drawer antitipping safety device, which that prevents a drawer, without being locked up, from sliding out due to earthquakes and also prevents multiple drawers from being simultaneously opened.

DESCRIPTION OF THE PRIOR ART

Cabinets made up of drawers are a commonly used household storage device. In case that heavy articles are stored in the drawers, or multiple ones of the drawers are simultaneously pulled out, the cabinet may get tipped resulting from a force acting thereon, and eventually hurt a user. Or, in case of earthquakes, violent shaking of the cabinet may cause the drawers to slide out and thus making the cabinet tip down. In view of this, manufacturers proposed various types of cabinets that allow the drawers to be locked in position. An example is Taiwan Patent No. 179525, which discloses an improved drawer locking device that prevents a cabinet from tipping down, and such a device functions to prevent adjacent drawers to be opened at the same time. However, if a user uses both hands to simultaneously open two of the drawers, it is still possible for the user to simultaneously open two drawers. Further, such the device of such a patent is also incapable of preventing drawers that are not adjacent to each other from being simultaneously opened.

SUMMARY OF THE INVENTION

The primary objective of the present invention is to provide lock bar-on-slide rail style drawer antitipping safety device, which allows only one single drawer to be withdrawn out of a cabinet at a time and does not allow drawers that are not locked in place to fall out of the cabinet due to earthquakes.

To achieve the above objective, the present invention provides a lock bar-on-slide rail style drawer antitipping safety device, which comprises a cabinet body, a top drawer, at least one middle drawer, and at least one bottom drawer. The lock bar-on-slide rail style drawer antitipping safety device is characterized in that the top drawer, the middle drawer, and the bottom drawer are each provided with a sliding portion projecting from one side thereof. Each of the sliding portions is formed, in an end portion thereof facing toward an outside of the cabinet body, with an upper slope, a stop surface, and a lower slope, and the upper slope and the lower slope are respectively arranged on upper and lower ends of the stop surface and are inclined in a direction toward an inside of the cabinet body; and an end portion of each of the sliding portions that faces toward the inside of the cabinet body is extended as a straight line in a horizontal direction. A slide rail is arranged between the sliding portion and a latching portion of the top drawer and corresponds, in shape, to a lower edge of the sliding portion. The cabinet body comprises a vertical slide rail slidably mounted at one side that corresponds to the sliding portions. The vertical slide rail is provided, in a manner of being slidably mounted thereto in a sequence from top to bottom, a first lock bar, a second lock bar, and a third lock bar. A gap is present between a bottom end of the first lock bar and a top end of the second lock bar. The first lock bar is provided, on each of a top end and the bottom end thereof, with a stop portion projecting therefrom toward the sliding portion. The second lock bar is provided, on each of the top end and a bottom end thereof, with a stop portion projecting therefrom toward the sliding portion. The first lock bar is provided, on the bottom thereof, with a first bearing portion and a first bottom hole, and the first bearing portion is located upward of the first bottom hole. The second lock bar is provided, on the top thereof that faces toward the bottom end of the first lock bar, with a second top peg that projects therefrom and corresponds to the first bottom hole, and a top end of the second top peg is supported on the first bearing portion. The second lock bar is provided, on the bottom thereof, with a second bearing portion and a second bottom hole, and the second bearing portion is located upward of the second bottom hole. The third lock bar is provided, on the top thereof that faces toward the bottom of the second lock bar, with a third top peg that projects therefrom and corresponds to the second bottom hole, and a top end of the third top peg is supported on the second bearing portion. A first elastic element is arranged between a bottom of the third lock bar and the cabinet body.

The stop portion of the top end of the first lock bar is set at such as height as to correspond to the lower slope of the sliding portion of the top drawer and is positionable on the slide rail of the top drawer. The stop portion of the bottom end of the first lock bar is set at such a height as to correspond to the upper slope of the sliding portion of the middle drawer. The stop portion of the top end of the second lock bar is set at such a height as to correspond to the lower slope of the sliding portion of the middle drawer. The stop portion of the bottom end of the second lock bar is set at such a height as to correspond to the upper slope of the sliding portion of the bottom drawer. In this way, to open each of the drawers of the present invention, a user needs to continuously apply a force to pull the drawer to make the stop portion moving along the upper slope or the lower slope of the sliding portion. If the present invention is caused to shake or vibrate due to a factor of external forces, such as earthquakes, even if the directions of the forces may vary randomly, the sliding portions are only caused to move back and forth to repeatedly hit the stop portions, but the stop portions do not slide over the upper slopes or the lower slopes. As such, in case that the present invention is caused to shake or vibrate by an external force, each of the drawers cannot slide out, thereby preventing the potential risk that the cabinet is affected by the drawers that are sliding out to get tipped down.

In an attempt of a user to pull open the top drawer, the stop portion of the top end of the first lock bar is driven along the lower slope of the sliding portion of the top drawer to move downward and is supported on the slide rail. At the same time, the stop portion of the bottom end of the first lock bar also moves downward to reach a height corresponding to the stop surface of the sliding portion of the middle drawer, so as to make the middle drawer not openable. Further, the first bearing portion of the first lock bar applies a force to the second top peg, and the second top peg is moved downward to make the second lock bar moving downward, so that the stop portion of the bottom end of the second lock bar also moves downward to reach a height corresponding to the stop surface of the sliding portion of the bottom drawer, and consequently making the bottom drawer not openable. The second bearing portion of the second lock bar similarly applies a force to the third top peg, causing the third lock bar to compress the first elastic element. When the user pushes back the top drawer, the first lock bar is pushed upward by the incline section of the slide rail, so as to release the locking of the middle drawer, and the first elastic element pushes the second lock bar and the third lock bar back to original positions, releasing the locking of the bottom drawer.

In an attempt of a user to pull open the middle drawer, the stop portion of the bottom end of the first lock bar is driven along the upper slope of the sliding portion of the middle drawer to move upward, and at the same time, the stop portion of the top end of the first lock bar also moves upward to reach a height corresponding to the stop surface of the sliding portion of the top drawer, so as to make the top drawer A not openable. Meanwhile, the sliding portion of the middle drawer also drives the second lock bar to move downward, and the stop portion of the bottom end of the second lock bar is moved downward to reach a height corresponding to the stop surface of the sliding portion of the bottom drawer, so as to make the bottom drawer not openable. When the user pushes back the middle drawer, the first lock bar lowers down back to the original position, so as to release the locking of the top drawer, and the second lock bar and the third lock bar are pushed upward back to the original position by the first elastic element, releasing the locking of the bottom drawer.

In an attempt of a user to pull open the bottom drawer, the stop portion of the bottom end of the second lock bar is driven along the upper slope of the sliding portion of the bottom drawer to move upward, and at the same time, the stop portion of the top end of the second lock bar also moves upward to reach a height corresponding to the stop surface of the sliding portion of the middle drawer, so as to make the middle drawer not openable; and also, the second top peg pushes the first lock bar upward, so that the stop portion of the top end of the first lock bar is moved to a height corresponding to the stop surface of the sliding portion of the top drawer, making the top drawer also not openable. When the user pushes back the bottom drawer, the second lock bar lowers down back to the original position, so as to release the locking of the middle drawer, and meanwhile, the first lock bar also lowers down back to the original position to thereby release the locking of the top drawer.

When the user attempts to grip any two of the top drawer, the middle drawer, and the bottom drawer and pull the two out at the same time, vertical movements of the first lock bar and the second lock bar interfere with each other, making both of the two lock bars unable to move, so that the user cannot to simultaneously pull out and open multiple ones of the drawers, and as such, safety of the present invention is enhanced.

The present invention may further comprise a lock that is mounted in the cabinet body for selectively moving the vertical slide rail in a vertical direction. The lock can be a rotary lock. The top drawer, the middle drawer, and the bottom drawer are each provided, in a protruding form, with a latching portion below the sliding portion thereof. The vertical slide rail is provided with a latching plate corresponding to and projecting toward each of the latching portions, and each of the latching plates is set at such a height as to be below the corresponding one of the latching portions. The first lock bar, the second lock bar, and the third lock bar are each formed with a latch opening corresponding to one of the latching plates. If the user wishes to lock up the present invention, the lock is operated to drive the vertical slide rail to move upward, making each of the latching plates lifted up to a height corresponding to each of the latching portions, and as such, each of the drawers cannot be moved, thereby preventing the drawers from being opened. The latching plates are preset at default home positions that are below the latching portions, so that opening of the present invention is not affected thereby. To unlock, the lock is operated to lower the vertical slide rail downward back to the original or home position.

The present invention can be structured as a three-tier cabinet, or alternatively, the number of the middle drawer can be increased in the vertical direction to make a cabinet of four or more tiers. This is accompanied by including one or more extra second lock bars to lock up the additional middle drawers, so that when the top drawer is being opened, the first lock bar may simultaneously drive all the second lock bars to lock up all the middle drawers and the bottom drawer, and also, opening of the remaining ones of the drawers may similarly lock up the other drawers that are not being opened.

The present invention is applicable in various places, such as household, storeroom, business offices, and workshops, to help improve safety of drawer cabinets.

DETAILED DESCRIPTION OF THE PREFERRED EMBODIMENT

Figure 1:
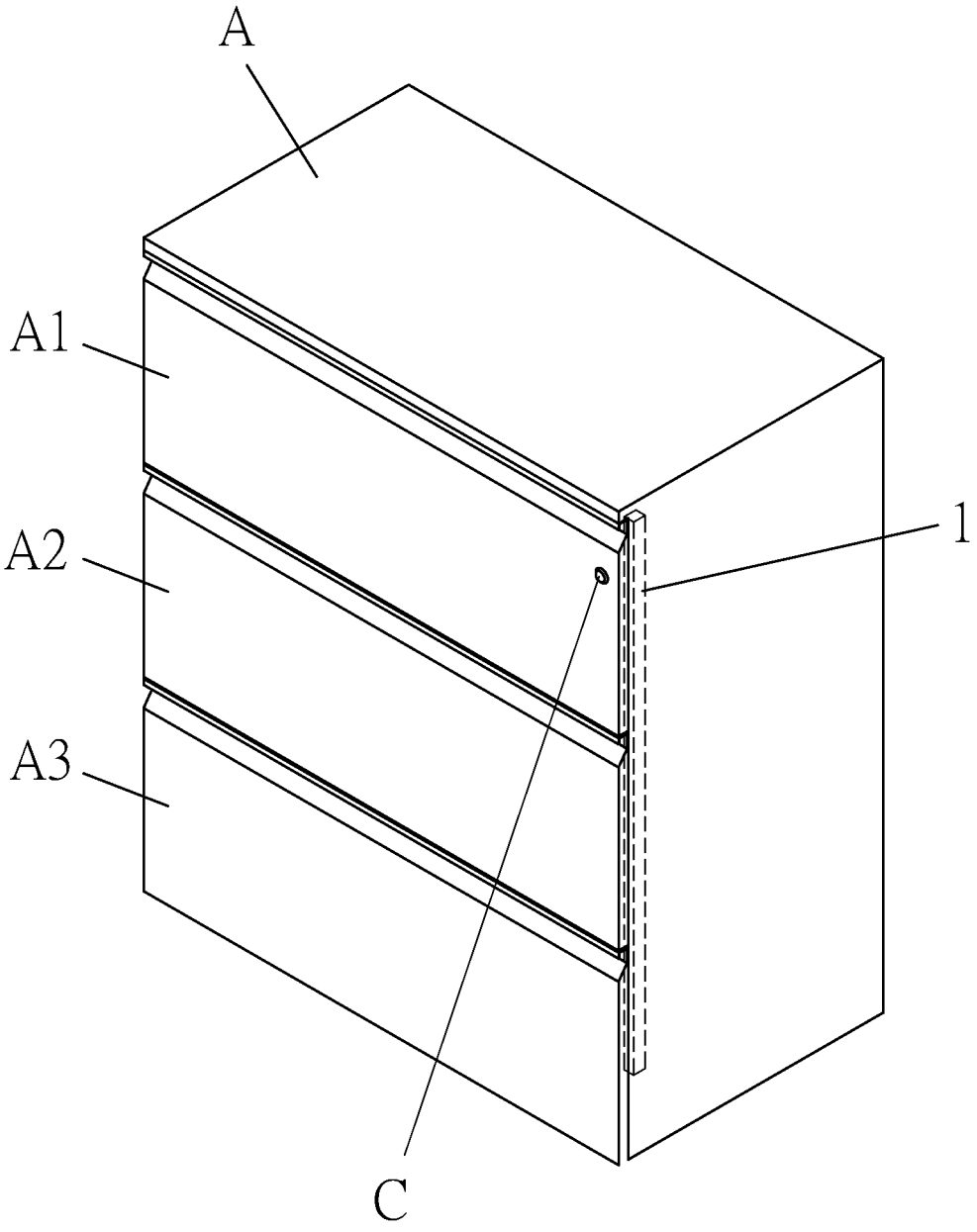
FIG. 1 is a perspective view of the present invention.
Figure 2:
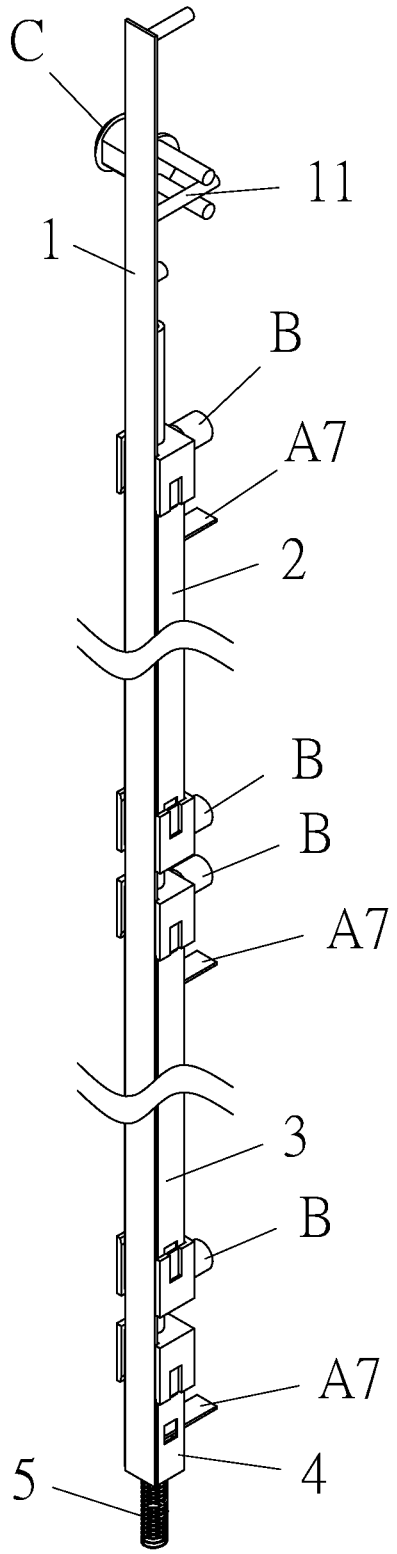
FIG. 2 is a perspective view showing a vertical slide rail of the present invention.

Referring to FIGS. 1-5, which are drawings showing an embodiment of the present invention, it is noted that through the disclosure, similar elements are designated with the same reference signs. As shown in the drawings, a lock bar-on-slide rail style drawer antitipping safety device according to the present invention comprises a cabinet body A, a top drawer A1, at least one middle drawer A2, and at least one bottom drawer A3. The lock bar-on-slide rail style drawer antitipping safety device is characterized in that the top drawer A1, the middle drawer A2, and the bottom drawer A3 are each provided with a sliding portion A4 projecting from one side thereof. Each of the sliding portions A4 is formed, in an end portion thereof facing toward an outside of the cabinet body A, with an upper slope A41, a stop surface A42, and a lower slope A43, and the upper slope A41 and the lower slope A43 are respectively arranged on upper and lower ends of the stop surface A42 and are inclined in a direction toward an inside of the cabinet body A; and an end portion of each of the sliding portions A4 that faces toward the inside of the cabinet body A is extended as a straight line in a horizontal direction, so that each of the sliding portions A4 is shaped like a bullet. A slide rail A5 is arranged below the sliding portion A4 of the top drawer A1 and corresponds, in shape, to a lower edge of the sliding portion A4. Spacing is formed between the slide rail A5 and the sliding portion A4. The slide rail A5 has a shape corresponding to that of a bottom of the sliding portion A4, and accordingly, the slide rail A5 includes a supporting section A51 that is arranged horizontal, an incline section A52 that extends oblique downward, and a horizontal section A53 that extends horizontally. The incline section A52 corresponds to the lower slope A43, and the horizontal section A53 corresponds to the horizontally-extending section of the sliding portion A4.

The cabinet body A includes a vertical slide rail 1 slidably mounted at one side that corresponds to the sliding portions A4. The vertical slide rail 1 is provided, in a manner of being slidably mounted thereto in a sequence from top to bottom, a first lock bar 2, a second lock bar 3, and a third lock bar 4. A gap is present between a bottom end of the first lock bar 2 and a top end of the second lock bar 3. The first lock bar 2 is provided, on each of a top end and the bottom end thereof, with a stop portion B projecting therefrom toward the sliding portion A4. The second lock bar 3 is provided, on each of the top end and a bottom end thereof, with a stop portion B projecting therefrom toward the sliding portion A4. The first lock bar 2 is provided, on the bottom thereof, with a first bearing portion 22 and a first bottom hole 21, and the first bearing portion 22 is located upward of the first bottom hole 21. The second lock bar 3 is provided, on the top thereof that faces toward the bottom end of the first lock bar 2, with a second top peg 33 that projects therefrom and corresponds to the first bottom hole 21. A top end of the second top peg 33 is supported on the first bearing portion 22. The second lock bar 3 is provided, on the bottom thereof, with a second bearing portion 32 and a second bottom hole 31, and the second bearing portion 32 is located upward of the second bottom hole 31. The third lock bar 4 is provided, on the top thereof that faces toward the bottom of the second lock bar 3, with a third top peg 41 that projects therefrom and corresponds to the second bottom hole 31. A top end of the third top peg 41 is supported on the second bearing portion 32. A first elastic element 5 is arranged between a bottom of the third lock bar 4 and the cabinet body A, and in the instant embodiment, the first elastic element 5 comprises a spring.

Figure 3:
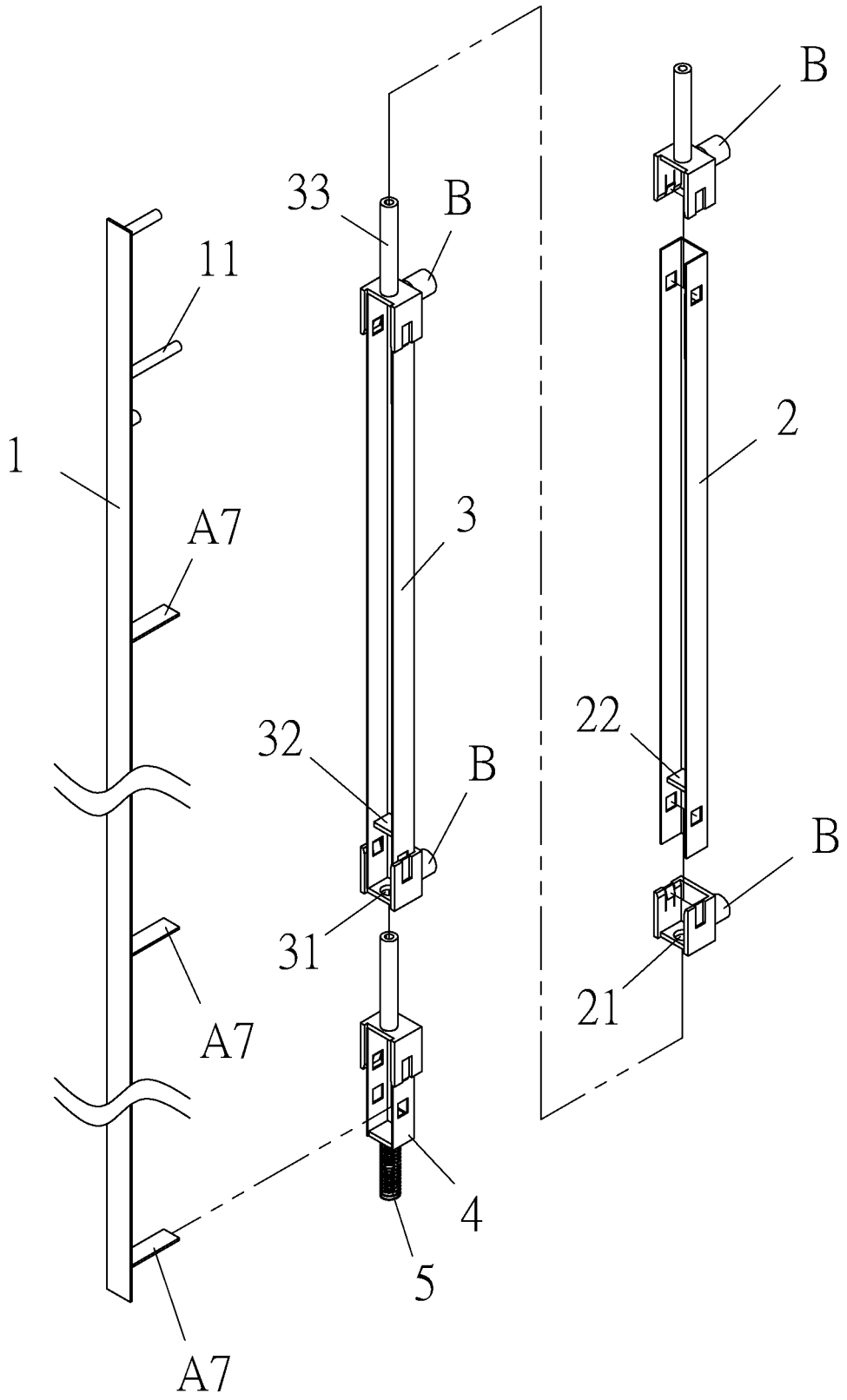
FIG. 3 is an exploded view of FIG. 2.

In the present invention, for each of the lock bars, the top peg and the bottom hole can be made as detachable parts as shown in FIG. 3, so that a lock bar can be equipped with a top peg or a hole at two ends thereof according to the position thereof in use. It can be appreciated that in the instant embodiment, the first lock bar 2 and the second lock bar 3 are of the same structure, and are specifically prefixed for the purposes of easing the description.

Figure 4:
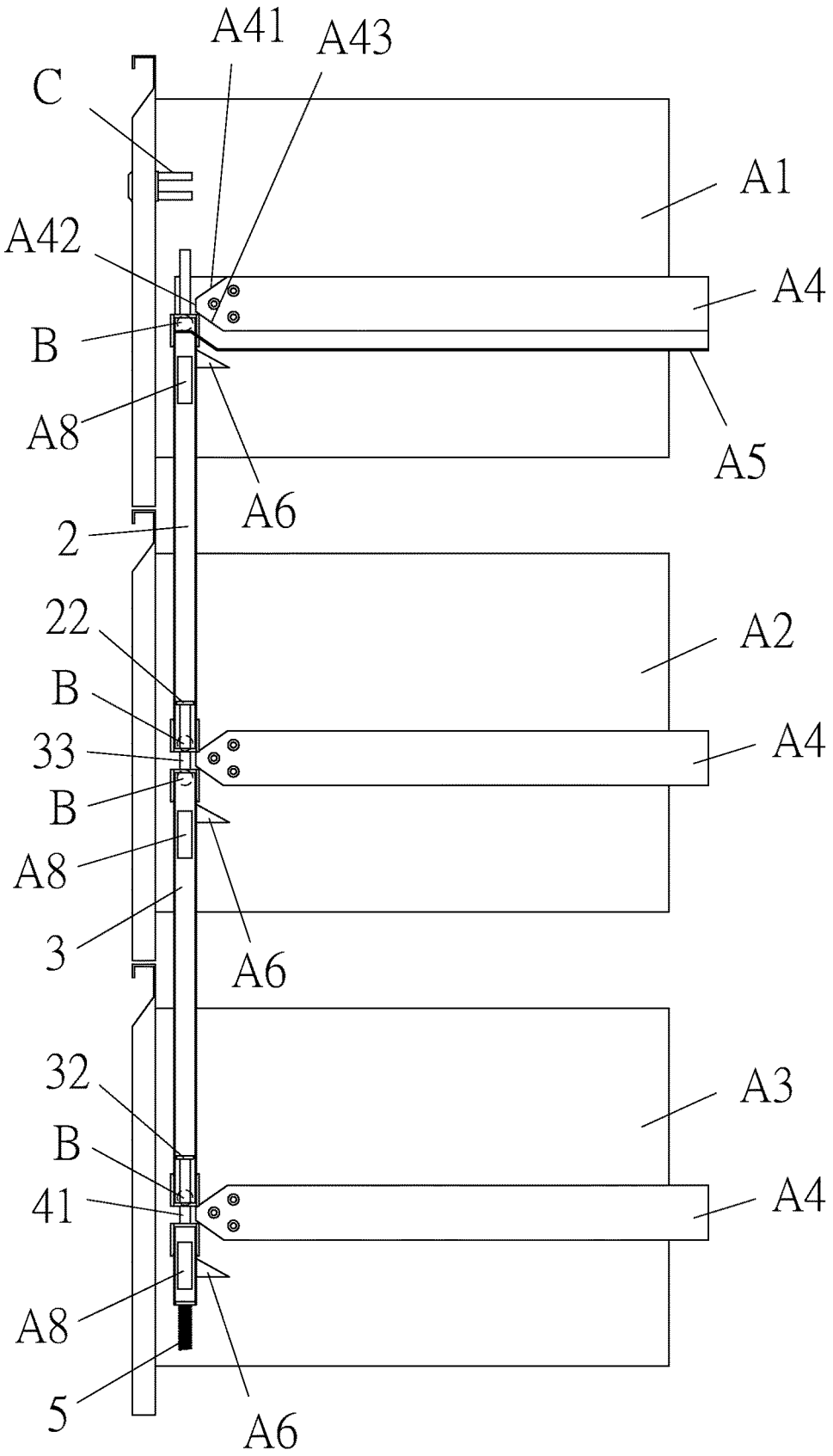
FIG. 4 is a side elevational view, in a sectioned form, of the present invention.
Figure 5:
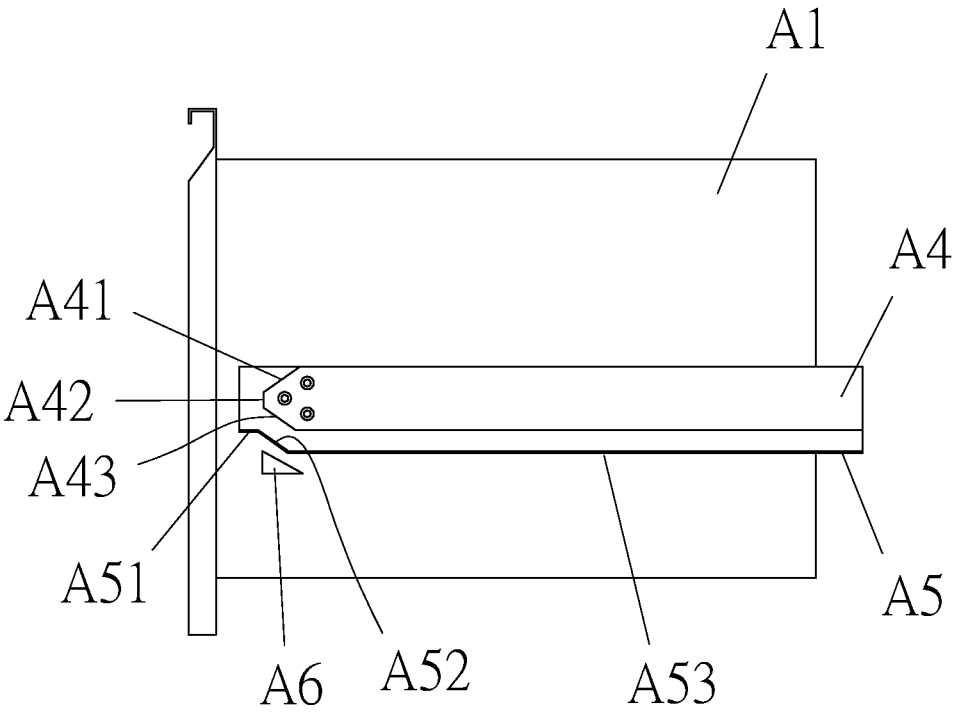
FIG. 5 is a side elevational view showing a top drawer of the present invention.

As shown in FIGS. 4 and 5, the stop portion B of the top end of the first lock bar 2 is set at such a height as to correspond to the lower slope A43 of the sliding portion A4 of the top drawer A1, and the stop portion B of the top end of the first lock bar 2 is positioned and supported on the supporting section A51 of the slide rail A5. The stop portion B of the bottom end of the first lock bar 2 is set at such a height as to correspond to the upper slope A41 of the sliding portion A4 of the middle drawer A2. The stop portion B of the top end of the second lock bar 3 is set at such a height as to correspond to the lower slope A43 of the sliding portion A4 of the middle drawer A2. The stop portion B of the bottom end of the second lock bar 3 is set at such a height as to correspond to the upper slope A41 of the sliding portion A4 of the bottom drawer A3. In the instant embodiment, each of the stop surface A42 is a vertical planar surface.

In this way, to open the top drawer A1, the middle drawer A2, the bottom drawer A3 of the present invention, a user needs to continuously apply a force to pull one of these drawers to make the stop portion B moving along the upper slope A41 or the lower slope A43 of the sliding portion A4, so as to consequently drive the first lock bar 2, the second lock bar 3, and the third lock bar 4 to move upward/downward to lock up the remaining ones of the drawers. If the present invention is caused to shake or vibrate due to a factor of external forces, such as earthquakes, even if the directions of the forces may vary randomly, the sliding portions A4 are only caused to move back and forth to repeatedly hit the stop portions B, but the stop portions B do not slide over the upper slopes A41 or the lower slopes A43. As such, in case that the present invention is caused to shake or vibrate by an external force, the top drawer A1, the middle drawer A2, and the bottom drawer A3, even being not locked in position, do not slide out due to the shaking or vibrating, thereby preventing the potential risk that the cabinet is affected by the drawers that are sliding out to get tipped down.

Figure 6:
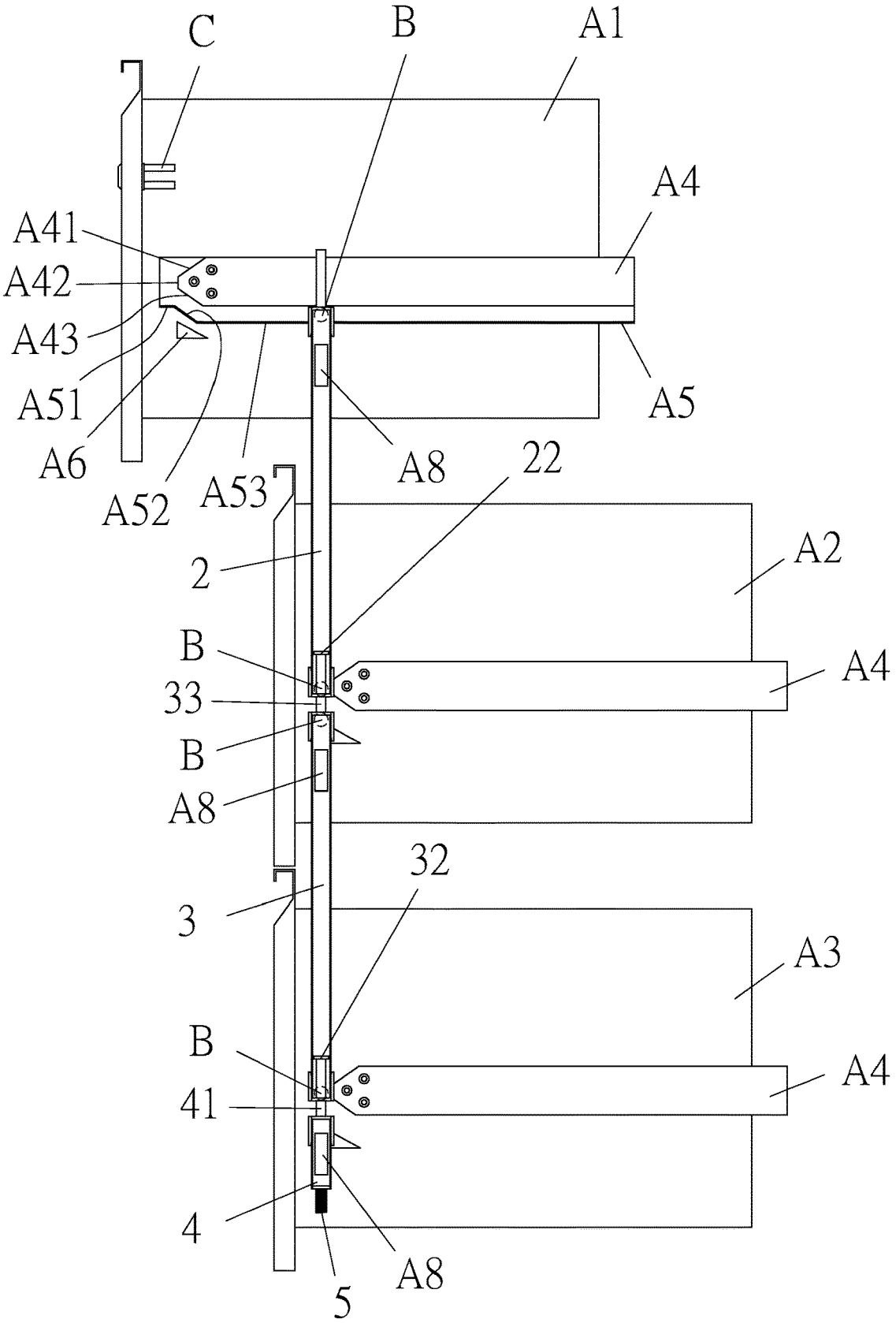
FIG. 6 is a first schematic view illustrating an operation of the present invention.

As shown in FIG. 6, in an attempt of a user to pull open the top drawer A1, the stop portion B of the top end of the first lock bar 2 is driven along the lower slope A43 of the sliding portion A4 of the top drawer A1 to move downward and is supported on the slide rail A5. At the same time, the stop portion B of the bottom end of the first lock bar 2 also moves downward to reach a height corresponding to the stop surface A42 of the sliding portion A4 of the middle drawer A2, so as to make the middle drawer A2 not openable. Further, the first bearing portion 22 of the first lock bar 2 applies a force to the second top peg 33, and the second top peg 33 is moved downward to make the second lock bar 3 moving downward, so that the stop portion B of the bottom end of the second lock bar 3 also moves downward to reach a height corresponding to the stop surface A42 of the sliding portion A4 of the bottom drawer A3, and consequently making the bottom drawer A3 not openable. The second bearing portion 32 of the second lock bar 3 similarly applies a force to the third top peg 41, causing the third lock bar 4 to compress the first elastic element 5. When the user pushes back the top drawer A1, the first lock bar 2 is pushed upward by the incline section A52 of the slide rail A5, so as to release the locking of the middle drawer A2, and the first elastic element 5 pushes the second lock bar 3 and the third lock bar 4 back to original positions, releasing the locking of the bottom drawer A3.

Figure 7:
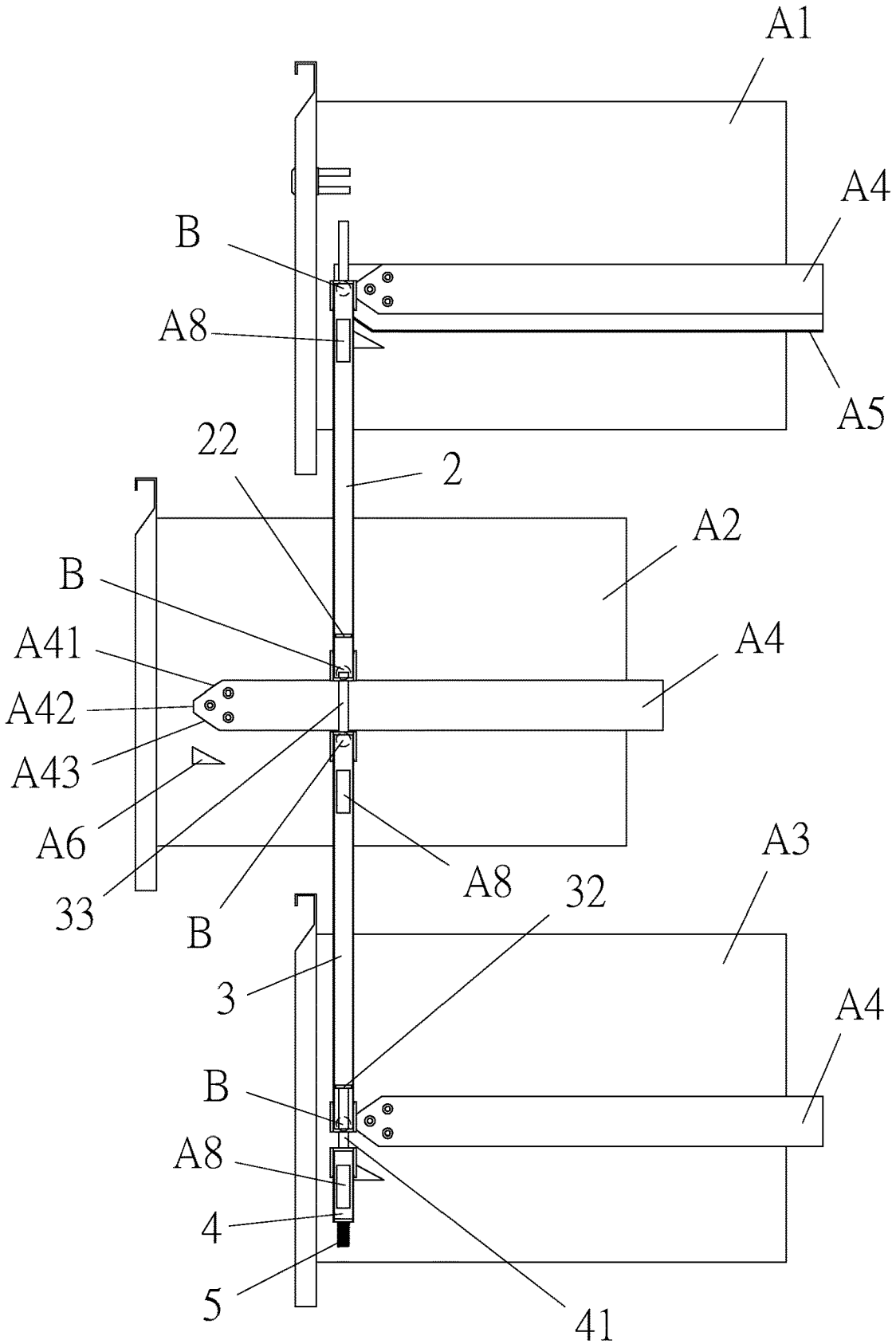
FIG. 7 is a second schematic view illustrating an operation of the present invention.

As shown in FIG. 7, in an attempt of a user to pull open the middle drawer A2, the stop portion B of the bottom end of the first lock bar 2 is driven along the upper slope A41 of the sliding portion A4 of the middle drawer A2 to move upward, and at the same time, the stop portion B of the top end of the first lock bar 2 also moves upward to reach a height corresponding to the stop surface A42 of the sliding portion A4 of the top drawer A1, so as to make the top drawer A not openable. Meanwhile, the sliding portion A4 of the middle drawer A2 also drives the second lock bar 3 to move downward, and the stop portion B of the bottom end of the second lock bar 3 is moved downward to reach a height corresponding to the stop surface A42 of the sliding portion A4 of the bottom drawer A3, so as to make the bottom drawer A3 not openable. When the user pushes back the middle drawer A2, the first lock bar 2 lowers down back to the original position, so as to release the locking of the top drawer A1, and the second lock bar 3 and the third lock bar 4 are pushed upward back to the original position by the first elastic element 5, releasing the locking of the bottom drawer A3.

Figure 8:
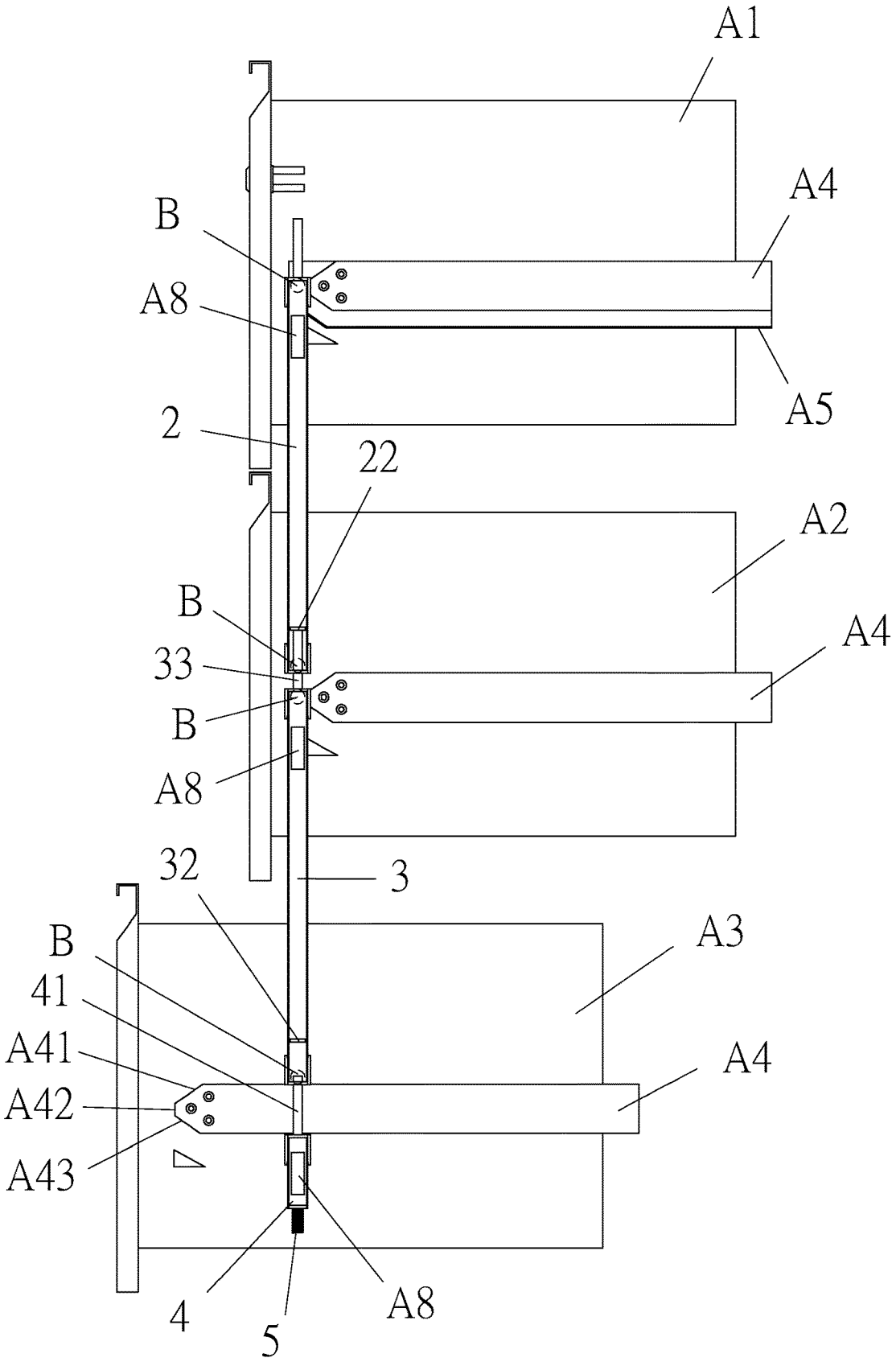
FIG. 8 is a third schematic view illustrating an operation of the present invention.

As shown in FIG. 8, in an attempt of a user to pull open the bottom drawer A3, the stop portion B of the bottom end of the second lock bar 3 is driven along the upper slope A41 of the sliding portion A4 of the bottom drawer A3 to move upward, and at the same time, the stop portion B of the top end of the second lock bar 3 also moves upward to reach a height corresponding to the stop surface A42 of the sliding portion A4 of the middle drawer A2, so as to make the middle drawer A2 not openable; and also, the second top peg 33 pushes the first lock bar 2 upward, so that the stop portion B of the top end of the first lock bar 2 is moved to a height corresponding to the stop surface A42 of the sliding portion A4 of the top drawer A1, making the top drawer A1 also not openable. When the user pushes back the bottom drawer A3, the second lock bar 3 lowers down back to the original position, so as to release the locking of the middle drawer A2, and meanwhile, the first lock bar 2 also lowers down back to the original position to thereby release the locking of the top drawer A1.

When the user attempts to grip any two of the top drawer A1, the middle drawer A2, and the bottom drawer A3 and pull the two out at the same time, vertical movements of the first lock bar 2 and the second lock bar 3 interfere with each other, making both of the two lock bars unable to move, so that the user cannot to simultaneously pull out and open multiple ones of the drawers, and as such, safety of the present invention is enhanced.

Figure 9:
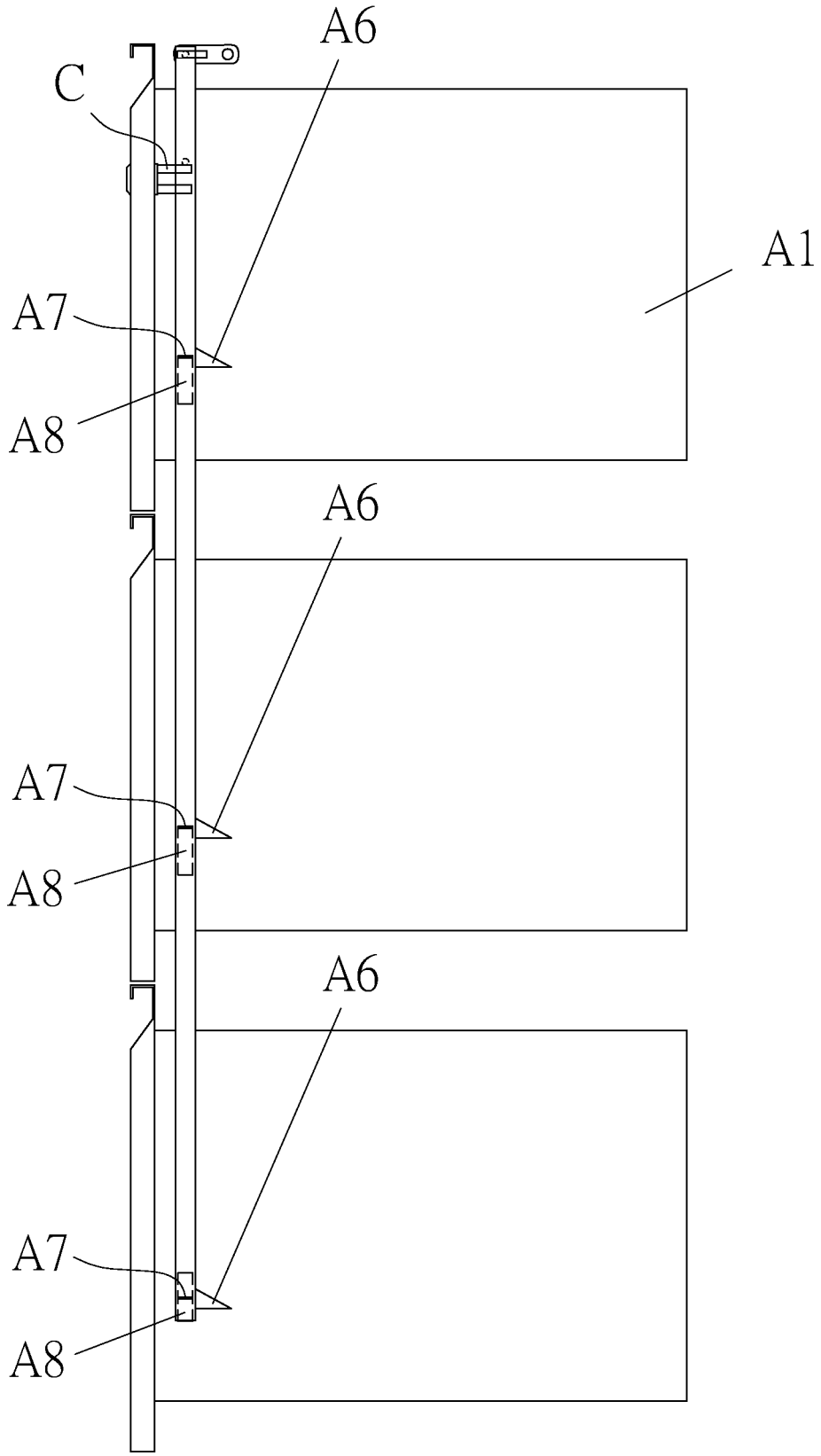
FIG. 9 is a fourth schematic view illustrating an operation of the present invention.

The present invention is alternatively structured to further include a lock C that is mounted in the cabinet body A for selectively moving the vertical slide rail 1 in a vertical direction. In the instant embodiment, the lock C is mounted on the top drawer A1. The lock C, in the instant embodiment, is a rotary lock. The vertical slide rail 1 is provided, in a projecting form, with a transverse or horizontal axle 11 at a location corresponding to the lock C, so that the lock C is rotatable to lift up or lower down the vertical slide rail 1. The top drawer A1, the middle drawer A2, and the bottom drawer A3 are each provided, in a protruding form, with a latching portion A6 below the sliding portion A4 thereof. In the instant embodiment, the latching portions A6 are each made in the form of a triangle of which a side is parallel to the stop surface A42. The latching portion A6 of the top drawer A1 is arranged below the slide rail A5. The vertical slide rail 1 is provided with a latching plate A7 corresponding to and projecting toward each of the latching portions A6, and each of the latching plates A7 is set at such a height as to be below the corresponding one of the latching portions A6. The first lock bar 2, the second lock bar 3, and the third lock bar 4 are each formed with a latch opening A8 corresponding to one of the latching plates A7. The latch openings A8 allow the corresponding ones of the latching plates A7 to pass therethrough, and each of the latch openings A8 is of a predetermined height in the vertical direction, so that when the vertical slide rail 1 is being moved in the vertical direction, the latching plates A7 may not interfere with by upper ends of the latch openings A8 to thereby drive the first lock bar 2, the second lock bar 3, and the third lock bar 4 to move in unison therewith, and thus, the first lock bar 2, the second lock bar 3, and the third lock bar 4 can be kept in their original positions during the movement of the vertical slide rail 1. If the user wishes to lock up the present invention, as shown in FIG. 9, the lock C is operated to drive the vertical slide rail 1 to move upward, making each of the latching plates A7 lifted up to a height corresponding to each of the latching portions A6, and as such, the top drawer A1, the middle drawer A2, and the bottom drawer A3 cannot be moved, thereby preventing the top drawer A1, the middle drawer A2, and the bottom drawer A3 from being opened. The latching plates A7 are preset at default home positions that are below the latching portions A6, so that opening of the present invention is not affected thereby. To unlock, the lock C is operated to lower the vertical slide rail 1 downward back to the original or home position, and each of the latching plates A7 is thus returned to the default home position.

The present invention can be structured as a three-tier cabinet, as discussed in the instant embodiment, or alternatively, the number of the middle drawer A2 can be increased in the vertical direction to make a cabinet of four or more tiers. This is accompanied by including one or more extra second lock bars 3 to lock up the additional middle drawers A2, so that when the top drawer A1 is being opened, the first lock bar 2 may simultaneously drive all the second lock bars 3 to lock up all the middle drawers A2 and the bottom drawer A3, and also, opening of the remaining ones of the drawers may similarly lock up the other drawers that are not being opened.

The present invention is applicable in various places, such as household, storeroom, business offices, and workshops, to help improve safety of drawer cabinets.

I claim:

1. A lock bar-on-slide rail style drawer antitipping safety device, comprising a cabinet body, a top drawer, at least one middle drawer, and at least one bottom drawer, wherein the top drawer, the at least one middle drawer, and the at least one bottom drawer are each provided with a sliding portion projecting from one side thereof, wherein each of the sliding portions is formed, in an end portion thereof facing toward an outside of the cabinet body, with an upper slope, a stop surface, and a lower slope, and the upper slope and the lower slope are respectively arranged on upper and lower ends of the stop surface and are inclined in a direction toward an inside of the cabinet body; and an end portion of each of the sliding portions that faces toward the inside of the cabinet body is extended as a straight line in a horizontal direction; a slide rail is arranged below the sliding portion of the top drawer and corresponding, in shape, to a lower edge of the sliding portion; and the cabinet body comprises a vertical slide rail slidably mounted at one side that corresponds to the sliding portions, wherein the vertical slide rail is provided, in a manner of being slidably mounted thereto in a sequence from top to bottom, a first lock bar, a second lock bar, and a third lock bar, a gap being present between a bottom end of the first lock bar and a top end of the second lock bar, wherein the first lock bar is provided, on each of a top end and the bottom end thereof, with a stop portion projecting therefrom toward the sliding portion; the second lock bar is provided, on each of the top end and a bottom end thereof, with a stop portion projecting therefrom toward the sliding portion; the first lock bar is provided, on the bottom thereof, with a first bearing portion and a first bottom hole, the first bearing portion being located upward of the first bottom hole; the second lock bar is provided, on the top thereof that faces toward the bottom end of the first lock bar, with a second top peg that projects therefrom and corresponds to the first bottom hole, a top end of the second top peg being supported on the first bearing portion; the second lock bar is provided, on the bottom thereof, with a second bearing portion and a second bottom hole, the second bearing portion being located upward of the second bottom hole; the third lock bar is provided, on the top thereof that faces toward the bottom of the second lock bar, with a third top peg that projects therefrom and corresponds to the second bottom hole, a top end of the third top peg being supported on the second bearing portion; and a first elastic element is arranged between a bottom of the third lock bar and the cabinet body.

2. The lock bar-on-slide rail style drawer antitipping safety device according to claim 1, wherein the stop portion of the top end of the first lock bar is set at such a height as to correspond to the lower slope of the sliding portion of the top drawer and is positionable on the slide rail of the top drawer; the stop portion of the bottom end of the first lock bar is set at such a height as to correspond to the upper slope of the sliding portion of the at least one middle drawer; the stop portion of the top end of the second lock bar is set at such a height as to correspond to the lower slope of the sliding portion of the at least one middle drawer; the stop portion of the bottom end of the second lock bar is set at such a height as to correspond to the upper slope of the sliding portion of the at least one bottom drawer.

3. The lock bar-on-slide rail style drawer antitipping safety device according to claim 1, further comprising a lock that is mounted in the cabinet body for selectively moving the vertical slide rail in a vertical direction; the top drawer, the at least one middle drawer, and the at least one bottom drawer are each provided, in a protruding form, with a latching portion below the sliding portion thereof; the vertical slide rail is provided with a latching plate corresponding to and projecting toward each of the latching portions, and each of the latching plates is set at such a height as to be below the corresponding one of the latching portions; and the first lock bar, the second lock bar, and the third lock bar are each formed with a latch opening corresponding to one of the latching plates.

4. The lock bar-on-slide rail style drawer antitipping safety device according to claim 1, wherein the slide rail comprises a supporting section that is arranged horizontal, an incline section that extends oblique downward, and a horizontal section that extends horizontally.

* * * * *